US007857477B2

(12) United States Patent
Wilborn et al.

(10) Patent No.: US 7,857,477 B2
(45) Date of Patent: Dec. 28, 2010

(54) ARTICLE OF CLOTHING WITH WASHABLE LIGHT MODULE

(75) Inventors: Donald Wilborn, Nokomis, FL (US); Rudy Guzman, Coral Springs, FL (US)

(73) Assignee: BBC Internatinoal LLC, Boca Raton, FL (US)

( * ) Notice: Subject to any disclaimer, the term of this patent is extended or adjusted under 35 U.S.C. 154(b) by 0 days.

(21) Appl. No.: 12/061,754

(22) Filed: Apr. 3, 2008

(65) Prior Publication Data

US 2009/0251077 A1 Oct. 8, 2009

(51) Int. Cl.
*F21V 21/08* (2006.01)

(52) U.S. Cl. ..... 362/103; 362/800; 362/267; 362/249.02; 362/249.12; 362/311.15

(58) Field of Classification Search ..... 362/103, 362/800, 267, 276, 802, 249.02, 249.05, 362/249.12, 255, 311.02, 311.04, 311.14, 362/311.15
See application file for complete search history.

(56) References Cited

U.S. PATENT DOCUMENTS

| | | | |
|---|---|---|---|
| 2,940,184 | A | 6/1960 | Malone |
| 4,043,241 | A | 8/1977 | Liu |
| 4,207,087 | A | 6/1980 | Morrison et al. |
| 4,646,350 | A | 2/1987 | Batra |
| 4,771,556 | A | 9/1988 | Kim |
| 5,159,768 | A | 11/1992 | Longo, Jr. |
| 5,343,190 | A | 8/1994 | Rodgers |
| 5,345,700 | A | 9/1994 | Norment |
| 5,381,615 | A | 1/1995 | MacMillan |
| 5,402,590 | A | 4/1995 | Lee |
| 5,422,628 | A | 6/1995 | Rodgers |
| 5,483,759 | A | 1/1996 | Silverman |
| 5,530,626 | A | 6/1996 | Norment |
| 5,649,376 | A | 7/1997 | Lecates, Jr. |
| 5,714,706 | A | 2/1998 | Nakada et al. |
| 5,765,300 | A | 6/1998 | Kianka |
| 5,812,063 | A | 9/1998 | Weng et al. |
| 5,813,148 | A | 9/1998 | Guerra |
| 5,855,080 | A | 1/1999 | Van Staden |
| 5,860,727 | A | 1/1999 | Chien |
| 5,894,201 | A | 4/1999 | Wong |
| 5,909,088 | A | 6/1999 | Wut |

(Continued)

FOREIGN PATENT DOCUMENTS

| | | |
|---|---|---|
| DE | 35 05 943 A1 | 8/1986 |

(Continued)

*Primary Examiner*—Sandra L O Shea
*Assistant Examiner*—Jessica L McMillan
(74) *Attorney, Agent, or Firm*—GrayRobinson, P.A.

(57) ABSTRACT

This invention is directed to an article of clothing having a lighting system that may be laundered with the clothing without damage to the electrical components of such system, comprising a light module that encapsulates and seals an electrical circuit coupled by one or more wires to a number of LEDs that are contained within a separate, leak-proof decorative patch. The patch is formed by a plastic base having an outer periphery that may be affixed to the article of clothing, such as by stitching, and a plastic cover preferably heat-sealed about its peripheral edge to the base defining a cavity between them within which the LEDs are mounted.

12 Claims, 5 Drawing Sheets

U.S. PATENT DOCUMENTS 5,969,479 A 10/1999 Wong
6,000,149 A 12/1999 Pomerantz
6,012,822 A 1/2000 Robinson
6,030,106 A 2/2000 Johnson
6,053,622 A 4/2000 Horowitz et al.
6,065,851 A * 5/2000 So ..... 362/103
6,238,056 B1 5/2001 Rapisarda
6,286,975 B1 9/2001 Rodgers
6,315,571 B1 11/2001 Lee
6,525,487 B2 2/2003 Wei
7,267,452 B2 9/2007 Esses
7,278,758 B2 10/2007 Esses
2002/0047646 A1 4/2002 Lys et al.
2002/0048169 A1 4/2002 Dowling et al.
2002/0070666 A1 6/2002 Van Den Bogert et al.
2003/0137258 A1 7/2003 Piepgras et al.
2004/0251631 A1 12/2004 Chou
2007/0291473 A1 * 12/2007 Traynor ..... 362/106
2008/0019120 A1 * 1/2008 Rapisarda ..... 362/103

FOREIGN PATENT DOCUMENTS

DE 203 17 143 U1 5/2004

* cited by examiner

ARTICLE OF CLOTHING WITH WASHABLE LIGHT MODULE

FIELD OF THE INVENTION

This invention relates to articles of clothing, and, more particularly, to articles of clothing having a decorative patch that houses a number of light sources coupled to a motion sensitive light module wherein both the patch and light module may be laundered with the clothing without damage.

BACKGROUND OF THE INVENTION

For a number of years, articles of footwear and various items of clothing have been sold with decorative arrays of light sources such as light emitting diodes (LEDs). This has been particularly popular in children's shoes where the LEDs are arranged to complement other design elements of the shoe such as cartoon characters and the like.

In a typical design of an article of clothing or footwear of the type noted above, a light module is provided including a plastic housing mounted at some location on or in the article. The module contains a battery, a switch and a controller which is connected by wires to LEDs located externally of the housing and positioned at desired locations on the footwear or garment. The integrated circuit is activated by the switch, and in many designs the switch is not operated manually but is turned on and off in response to the application of an inertial force, pressure or motion.

Articles of clothing such as shirts, pants, coats and the like made of cotton, wool or other cloth materials must be periodically laundered, and that has presented an issue with lighting systems of the type discussed above. Although the battery, switch and integrated circuit are encased within the housing of the light module and typically sealed from exposure to water, the LEDs and connecting wires are located externally of the housing and may be subject to damage from laundering.

One approach to addressing the problem of protecting electrical components in lighting systems for clothing from water damage during laundering is disclosed in U.S. Pat. Nos. 7,278,758 and 7,267,452. These patents teach enclosing all of the electrical components, including the battery, switch, controller and light sources such as LEDs, within a plastic casing. That casing is sealed within an envelope, preferably formed of two sections of plastic material. The envelope, in turn, is mounted within a compartment formed by an overlay which is heat-sealed to the garment. While providing protection for electrical components, the lighting system of these patents is limited in the decorative effects that can be achieved because all of the LEDs or other light sources must be clustered in the same location as the other electrical components within the plastic casing.

SUMMARY OF THE INVENTION

This invention is directed to an article of clothing having a lighting system that may be laundered with the clothing without damage to the electrical components of such system.

The lighting system comprises the combination of a light module and a number of light sources such as LEDs. The light module includes a plastic housing which encapsulates and seals an electrical circuit having a battery, a motion-responsive switch and a controller such as an integrated circuit. In one presently preferred embodiment, the electrical circuit is coupled by wires to the LEDs of the lighting system, which are contained within a leak-proof, decorative patch. The patch is formed by a plastic base having an outer periphery that may be affixed to the article of clothing, such as by stitching, and a plastic cover preferably heat-sealed about its peripheral edge to the base defining a cavity between them. The LEDs are arranged in essentially any pattern within the cavity, and, when actuated, illuminate a pattern formed on the cover such as a cartoon character or the like. The wires are connected between the light module and patch in such a way as to create a leak-proof seal to prevent the ingress of water into both structures that could otherwise result from laundering of the clothing, or due to perspiration when the clothing is worn.

In an alternative embodiment, a lighting system is provided which employs the same light module described above but in combination with an elongated, hollow tube preferably formed of transparent or translucent plastic. A number of LEDs are mounted at spaced intervals along the length of the tube and connected by at least one wire to the electrical circuit within the light module. The tube may be affixed to the article of clothing in essentially any pattern to provide the desired visual effect, and/or located beneath a cover of the type employed in the patch described above to provide illumination for the pattern appearing on the cover.

A still further embodiment of this invention comprises a plastic base having an outer periphery that may be affixed to the article of clothing, and a plastic cover whose peripheral edge is heat-sealed to the base forming a cavity between them. A printed circuit board (PCB) is sealed within the cavity, and an electrical circuit is mounted to the PCB. The electrical circuit includes a battery, a switch, an integrated circuit and preferably a number of LEDs.

BRIEF DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Referring initially to the embodiment of this invention illustrated in FIGS. 1-3 and 10, an article of clothing or garment 10 is depicted having a patch 12 affixed to a selected location thereof, which, for purposes of the present discussion, is identified as a mounting area 14. The patch 12 could be connected to essentially any area of the garment 10 so long as it is readily visible when the garment 10 is worn. The garment 10 is shown as a pair of pants but it should be understood that this invention applies to any article of clothing. Additionally, the terms "article of clothing" and "garment" are intended to be broadly construed to apply to other items that can be worn or carried on one's person such as knapsacks, fanny packs, backpacks, rucksacks, shoulder bags and the like.

Figure 2:
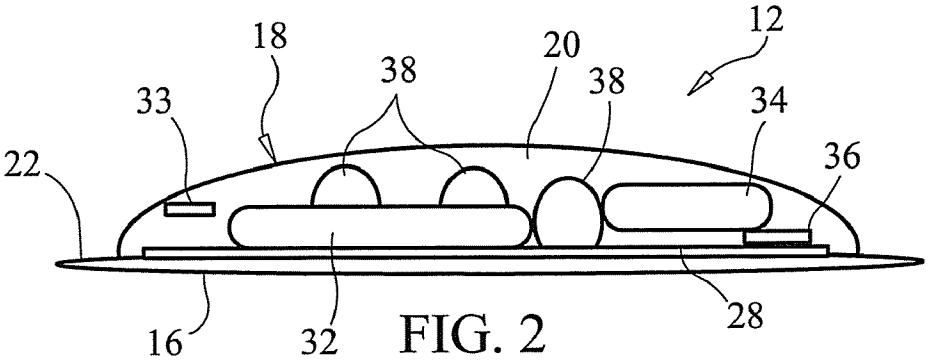
FIG. 2 is an elevated, side view of the system depicted in FIG. 1.
Figure 3:
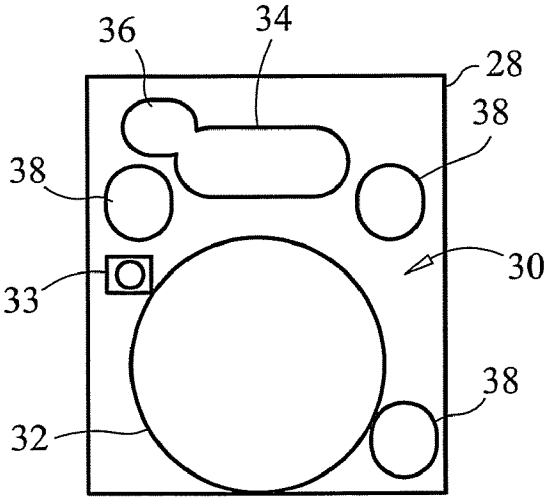
FIG. 3 is a plan view of the PCB and electrical circuit of the embodiment of FIG. 1.
Figure 1:
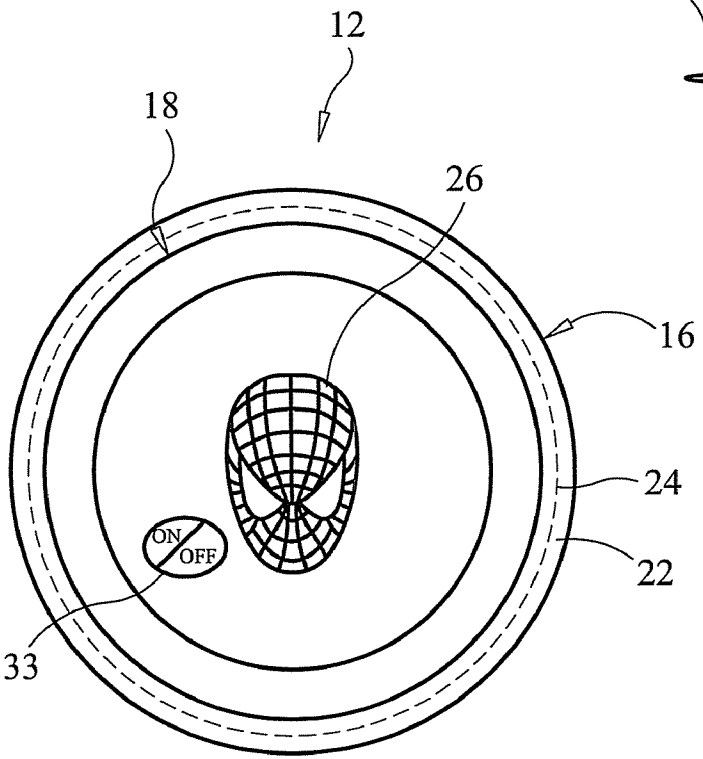
FIG. 1 is a plan view of one embodiment of this invention showing the design element on the cover of the decorative patch.

In the embodiment of FIGS. 1-3, the patch 12 comprises a base 16, preferably formed of pliable plastic material, and a cover 18 having a peripheral edge that is heat-sealed or otherwise permanently mounted to the base 16 forming a cavity 20 between the two. The base 16 and cover 18 are depicted in the drawings as generally circular in shape, although other configurations may be utilized and are considered within the scope of this invention. The cover 18 has a smaller diameter than the base 16 thus forming an annular flange 22 around the outer periphery of the base 16 when the two are connected to one another. The annular flange 22 provides a surface through which stitches 24 may pass for affixing the base 16, and, in turn, the cover 18, to the garment 10 as shown schematically in FIGS. 1-3. The cover 18 is preferably formed of a translucent or transparent material, such as a flexible plastic, and it has a pattern 26 on its surface which may be molded into the plastic, painted on the surface or applied in any other suitable manner.

A PCB 28 is mounted to the base 16 within the cavity 20 and is sealed, water-tight, by the connection between the base 16 and cover 18. The PCB 28 carries an electrical circuit 30 comprising a battery 32, an on/off switch 33, a motion switch 34, a controller such as an integrated circuit 36 and a number of LEDs 38 all coupled to one another. The detailed construction of the electrical components forming the circuit 30 forms no part of this invention and is therefore not discussed herein. One type of motion switch 34 suitable for use in the circuit 30 is a spring switch such as disclosed in U.S. Pat. No. 5,408,764. The integrated circuit 36 may be of the type commercially available under part number 6608 from Cheerine Development (Hong Kong) Ltd. of Kowloon, Hong Kong.

As noted above, the PCB 28 and circuit 30 are sealed within the cavity 20 so that no water can penetrate and damage the electrical components. In operation, when the on/off switch 33 is turned to the "on" position, the motion switch 34 is enabled so that in response to the application of motion to the patch 12 the switch 34 connects the battery 32 to the integrated circuit 36. In turn, the integrated circuit 36 operates the LEDs 38, preferably in a flashing or other sequence. The LEDs 38 are arranged on the PCB 28 to substantially uniformly illuminate the cover 18 which overlies the PCB 28 thus highlighting the pattern 26 on the cover 18 for the enjoyment of the wearer of the garment 10 and/or those viewing the garment 10.

Figure 4:
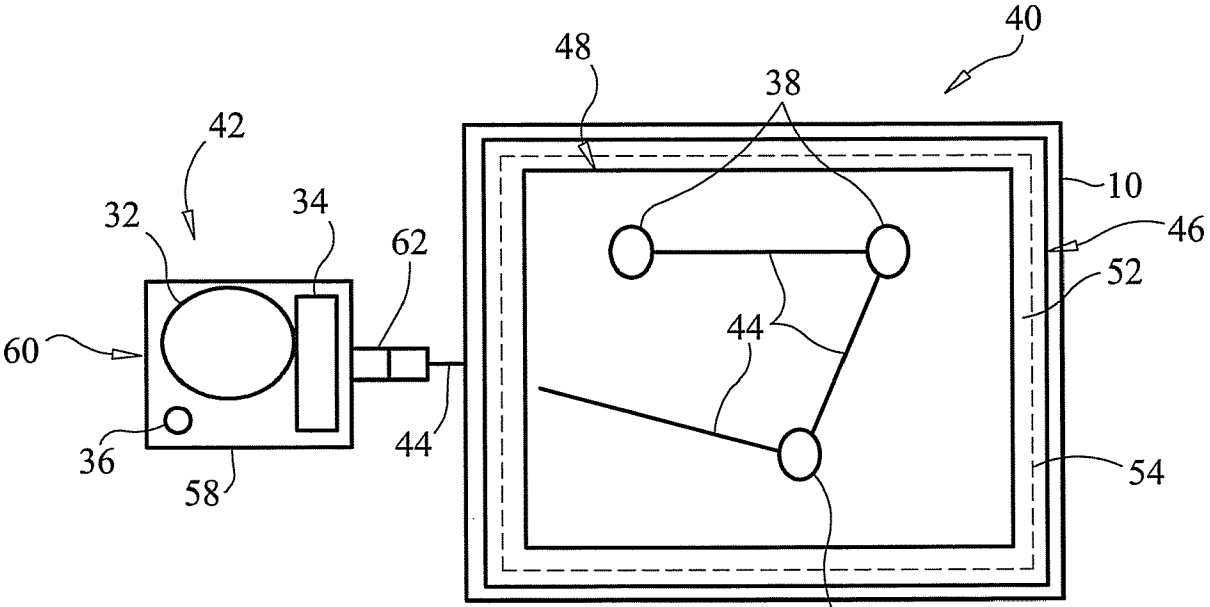
FIG. 4 is a plan view of an alternative embodiment of this invention illustrating the light module and the patch.
Figure 5:
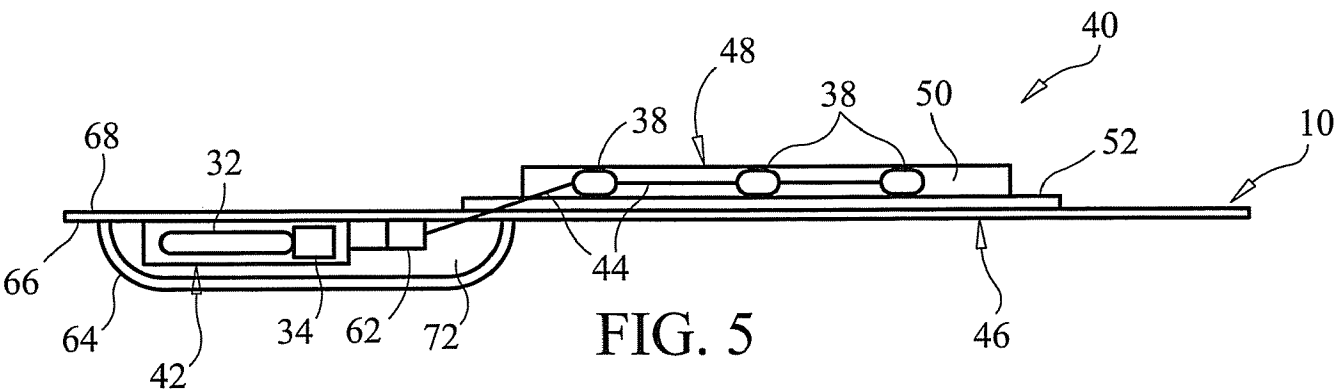
FIG. 5 is a side view of FIG. 4 except with the patch affixed to an article of clothing and the light module carried within a pocket mounted to the clothing.
Figure 6:
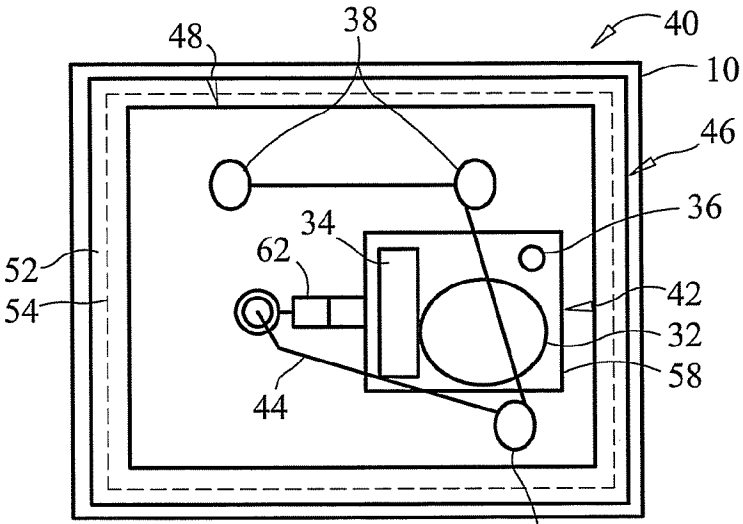
FIG. 6 is a plan view of still another embodiment of this invention.
Figure 7:
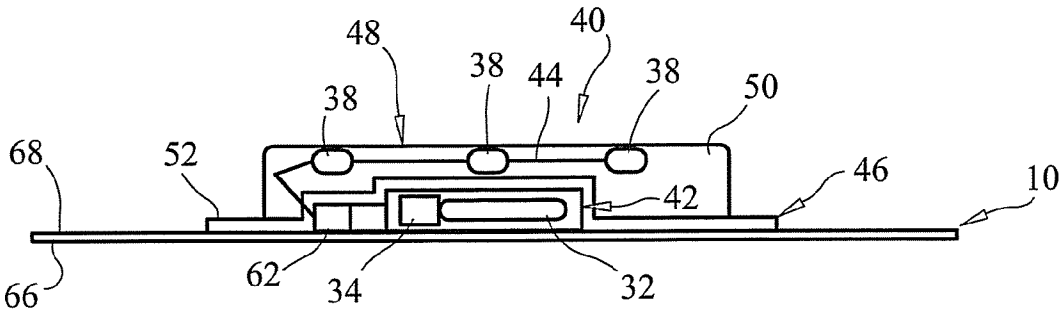
FIG. 7 is a side view of FIG. 6 except with the patch affixed to an article of clothing and the light module located between the patch and clothing.

Referring now to FIGS. 4 and 5, and to FIGS. 6 and 7, alternative embodiments of this invention are depicted. Some of the elements of these embodiments are the same as those described above in connection with a discussion of FIGS. 1-3, and, except as discussed below, the structure in FIGS. 4 and 5 is common to that of FIGS. 6 and 7. As such, the same reference numbers are employed in FIGS. 4-7 to denote common structure.

Figure 10:
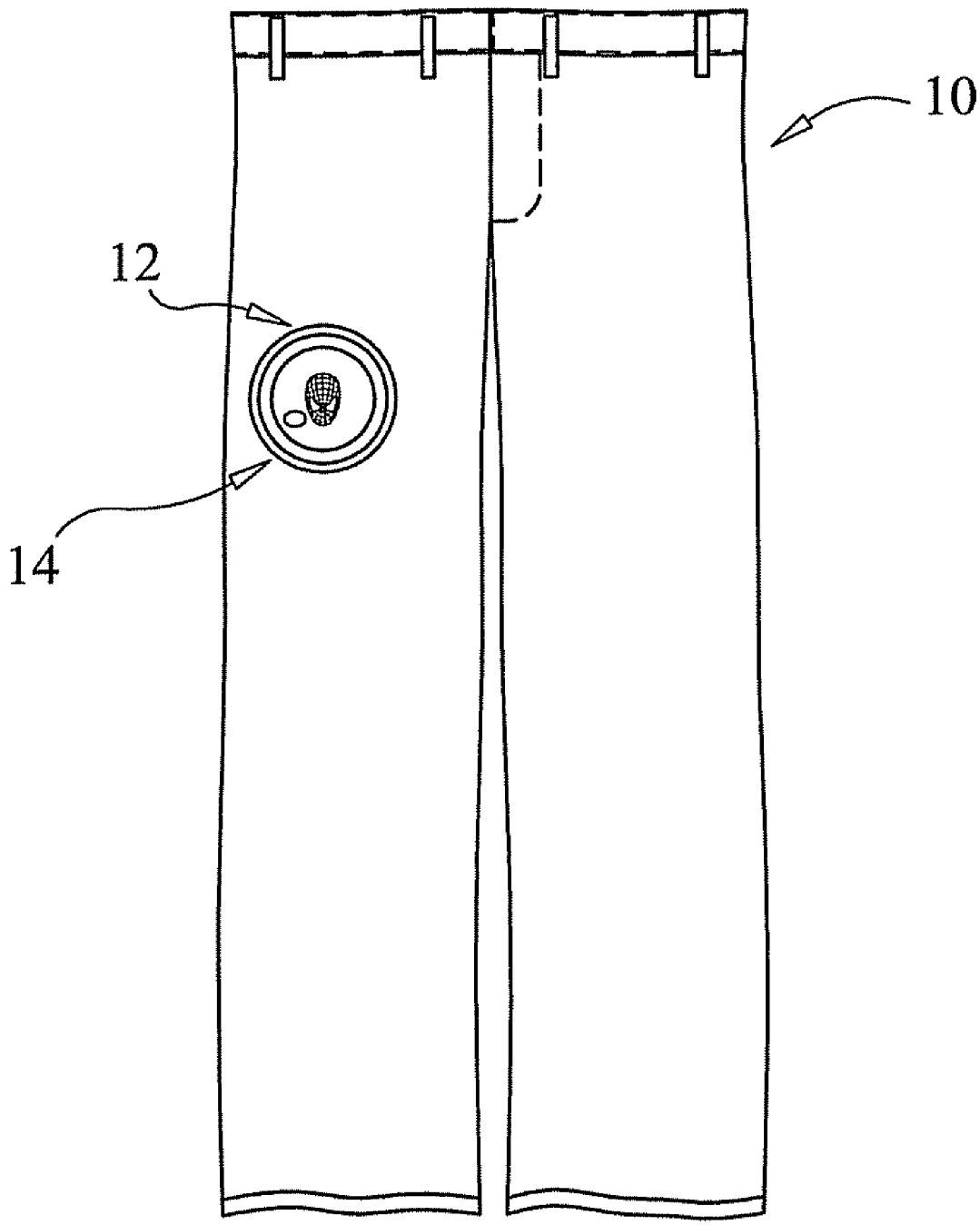
FIG. 10 is a schematic view of the lighting system herein affixed to an article of clothing.

In the embodiments illustrated in FIGS. 4 and 5, and in FIGS. 6 and 7, the garment 10 includes a patch 40 and a separate light module 42 connected by at least one wire 44. These elements may be located in the same mounting area 14 as depicted in FIG. 10 or elsewhere on the garment 10. The patch 40 includes a base 46, preferably formed of pliable plastic material, and a cover 48 having a peripheral edge that is heat-sealed or otherwise permanently mounted to the base 46 forming a compartment 50 between the two. The cover 48 is smaller in peripheral dimension than the base 16 thus forming a flange 52 around the outer periphery of the base 46 when the two are connected to one another. The flange 52 provides a surface through which stitches 54 may pass for affixing the base 46, and, in turn, the cover 48, to the garment 10 as shown schematically in FIGS. 4 and 5. The cover 48 is preferably formed of a translucent or transparent material, such as a flexible plastic, and it has a pattern (not shown), such as pattern 26, on its surface which may be molded into the plastic, painted on the surface or applied in any other suitable manner.

The light module 42 comprises a watertight plastic housing 58 having a hollow interior within which an electrical circuit 60 is encased including a battery 32, a motion switch 34 and an integrated circuit 36. Unlike the embodiment of FIGS. 1-3, an array of LEDs 38 are mounted remotely from the circuit 30 within the compartment 50 formed in the patch 40. Without any other electrical components present, or a PCB 28, the LEDs 38 may be arranged in any position within the compartment 50, different colored LEDs 38 may be utilized and greater numbers of LEDs may be employed to obtain desired visual effects when illuminated, compared to the embodiment of FIGS. 1-3.

As noted above, the LEDs 38 are connected to the circuit 60 within the light module 42 by at least one wire 44. A coupler 62 is preferably sealed to the side of the plastic housing 58 of module 42 in a watertight fashion, and connects the wire 44 to circuit 60. The opposite end of the wire 44 is sealed where it enters the compartment 50, such as by heat sealing to the base 46 and/or cover 48, and connects to the LEDs 38. The electrical circuit 60 operates in the same fashion as circuit 30 described above, except the on/off switch 33 is eliminated in this embodiment and the switch 34 operates to activate the integrated circuit 36 each time it is subjected to motion.

The primary difference between the embodiments of FIGS. 4 and 5, and FIGS. 6 and 7, is the location of the light module 42 with respect to the patch 40. In FIGS. 4 and 5, the light module 42 is carried within a pocket 64 located on the surface 66 of garment 10 opposite to the surface 68 on which the patch 40 is mounted. The pocket 64 is preferably formed of a section of the same material as the garment 10, which may be stitched or otherwise permanently attached to the garment 10. The pocket 64 forms a closed interior 72 so that the light module 42 is confined and cannot separate from the garment 10 during use or laundering. Alternatively, as shown in FIGS. 6 and 7, the light module 42 is located between the base 46 of the patch 40 and the surface 68 of the garment 10 within a recess formed in the base 46. The light module 42 is retained in place because it is enclosed underneath the base 46 which is stitched about its flange 52 to the garment 10.

Figure 8:
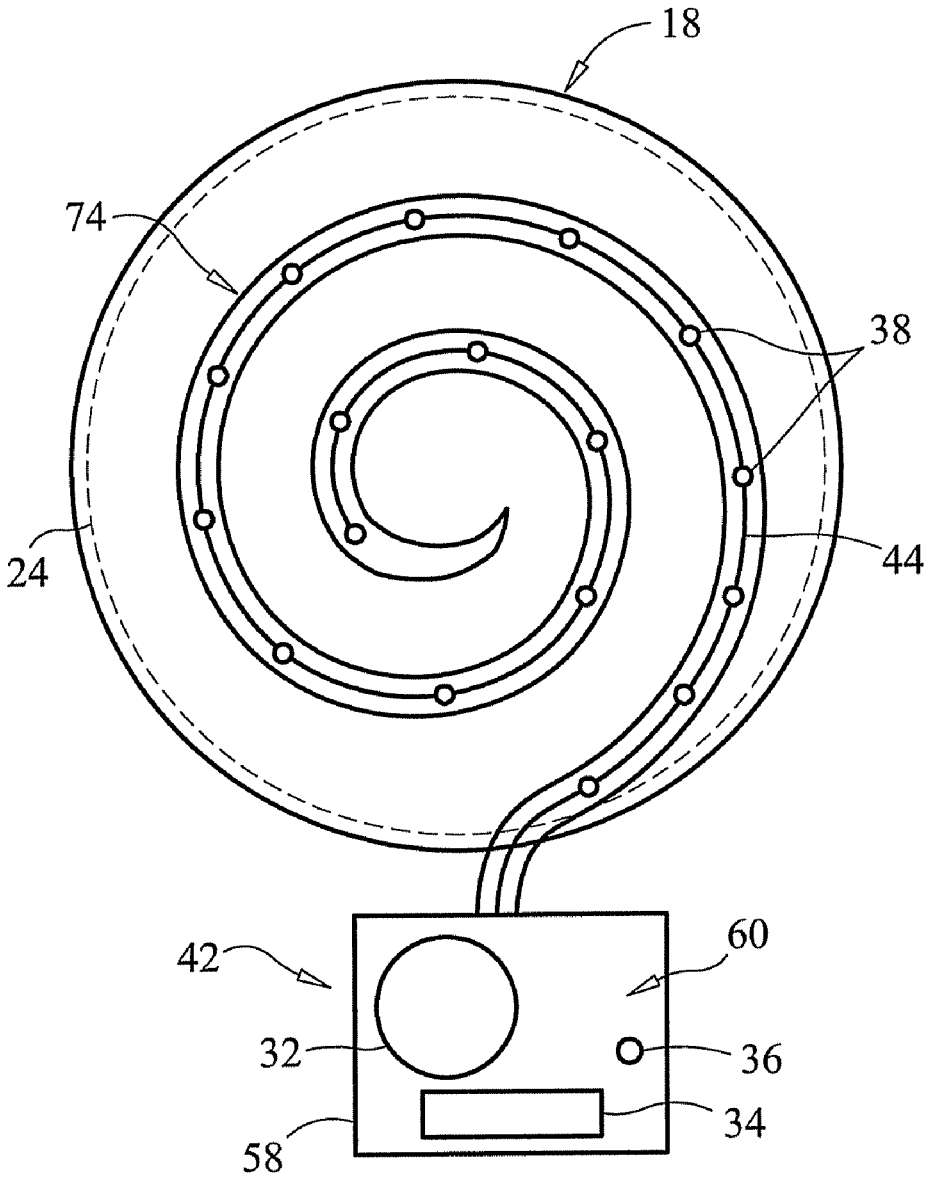
FIG. 8 is a plan view of a further embodiment of this invention depicting a light module connected to an elongated tube which is mounted beneath a cover affixed to an article of clothing.
Figure 9:
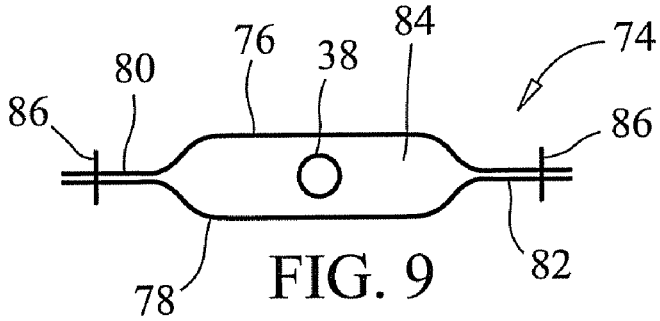
FIG. 9 is a cross section view of the tube shown in FIG. 8.

A still further embodiment of this invention is shown in FIGS. 8 and 9. The same light module 42 and circuit 60 described above in connection with a discussion of FIGS. 4-7 are employed in this embodiment, and the same reference numbers therefore apply to like structure. An elongated tube 74, preferably formed of pliable translucent or transparent plastic material, is coupled to the light module 42. The tube 74 is formed of a first section 76 and second section 78 that are heat sealed or otherwise connected to one another along their side edges to form opposed flanges 80 and 82. Sections 76, 78 are spaced from one another in the center to form a hollow interior 84. A number of LEDs 38 are mounted within the hollow interior 84, preferably at spaced intervals, and are connected by at least one wire 44 to the circuit 60 in the light module 42.

Each of the flanges 80, 82 may be connected by stitches 86 or other means to the garment 10 to secure it in place. Because the tube 74 is flexible, it may be arranged in many configurations on the garment 10, and the spiral-shape shown in FIG. 8 is intended for purposed of illustration only. Additionally, a cover 18 may be placed over the tube 74, and mounted by stitches 24 to the garment 10, to illuminate the pattern 26 on the cover 18 as depicted in FIG. 1. The tube 74 alone, or the tube 74 in combination with the cover 18, provide a wide variety of surface decoration and lighting effects on the garment 10 to enhance its appearance and the enjoyment of the wearer.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An article of clothing, comprising:

a mounting area having a first surface and a second surface opposite said first surface;

a patch coupled to said mounting area, said patch including a base connected to said first surface of said mounting area, a cover having a peripheral edge connected to said base forming a cavity between said base and said cover, and a number of light sources located within said cavity which are substantially sealed from exposure to water;

a light module located externally of said cavity of said patch, said light module including a housing defining a hollow interior and an electrical circuit located within said hollow interior, said electrical circuit being encased by said housing to substantially prevent exposure of said electrical circuit to water, said electrical circuit including a battery, a switch and a controller coupled to one another;

at least one wire connected between said light module and said light sources;

said controller of said electrical circuit being effective in response to activation of said motion switch to illuminate said light sources.

2. The article of clothing of claim 1 in which said light module is located between said base and said first surface of said mounting area.

3. The article of clothing of claim 1 in which said light module is mounted to said second surface of said mounting area.

4. The article of clothing of claim 3 further including a pocket connected to said second surface of said mounting area, said light module being carried within said pocket.

5. The article of clothing of claim 1 in which said cover is translucent or transparent and is formed with a pattern, said pattern being illuminated upon illumination of said light sources.

6. The article of clothing of claim 1 further including a coupler connected to said housing of said light module, said coupler connecting said at least one wire to said electrical circuit within said light module.

7. The article of clothing of claim 1 in which said base has an outer periphery, said peripheral edge of said cover being connected to said base at a location spaced from said outer periphery thereof thus defining a flange between said outer periphery and said peripheral edge, said flange being stitched to said mounting area.

8. An article of clothing, comprising:

a mounting area having a first surface and a second surface opposite said first surface;

a cover affixed to said first surface of said mounting area, a cavity being formed between said cover and said first surface;

an elongated tube having a hollow interior, said elongated tube being located within said cavity between said first surface of said mounting area and said cover so that said cover extends about said elongated tube, said elongated tube being affixed in a desired configuration to said first surface of said mounting area;

a number of light sources mounted within said hollow interior of said elongated tube and being substantially sealed from exposure to water;

a light module located externally of said cavity, said light module including a housing and an electrical circuit encased within said housing, such electrical circuit including a battery, a switch and a controller coupled to one another;

at least one wire coupled to said electrical circuit of said light module and to said light sources within said elongated tube, said controller being effective in response to actuation of said switch to illuminate said light sources.

9. The article of clothing of claim 8 in which said elongated tube is arranged between said cover and said mounting surface in such a way as to cause substantially the entire cover to be illuminated upon activation of said light sources.

10. The article of clothing of claim 8 in which said elongated tube includes a first wall and a second wall each having opposed side edges, said side edges of said first wall being connected to said side edges of said second wall to form opposed flanges.

11. The article of clothing of claim 10 in which at least one of said opposed flanges is affixed to said mounting area.

12. The article of clothing of claim 8 in which said cover is translucent or transparent and is formed with a pattern, said pattern being illuminated upon illumination of said light sources.

* * * * *